US005413452A

United States Patent [19]

Lech et al.

[11] Patent Number: 5,413,452

[45] Date of Patent: May 9, 1995

[54] HYDRAULIC SYSTEM FOR A BACKHOE APPARATUS

[75] Inventors: Richard J. Lech, Burlington, Iowa; Patrick J. Pieper, Carol Stream, Ill.

[73] Assignee: Case Corporation, Racine, Wis.

[21] Appl. No.: 38,703

[22] Filed: Mar. 29, 1993

[51] Int. Cl.[6] ..... E02F 3/00

[52] U.S. Cl. ..... 414/695.5; 60/422; 91/516

[58] Field of Search ..... 414/695.5, 695, 694, 414/686; 91/516; 60/422

[56] References Cited

U.S. PATENT DOCUMENTS

| | | | |
|---|---|---|---|
| 3,927,603 | 12/1975 | Bernhoft | 91/516 X |
| 3,994,133 | 11/1976 | Pfeil et al. | 60/422 |
| 4,007,845 | 2/1977 | Worback . | |
| 4,193,734 | 3/1980 | Williams | 414/694 |
| 4,556,078 | 12/1985 | Wittren | 91/516 X |
| 4,757,685 | 7/1988 | Burckhartzmeyer | 60/452 |
| 4,836,087 | 6/1989 | Nakagomi | 91/516 X |

*Primary Examiner*—Donald W. Underwood
*Attorney, Agent, or Firm*—Rudnick & Wolfe

[57] ABSTRACT

A hydraulic system suited for use with a backhoe apparatus and which is configured to automatically direct a priority flow of actuating fluid from an actuating fluid source to hydraulic motors used to swing the backhoe apparatus into a desired swing position independently of other backhoe operations and the corresponding loads thereof. The hydraulic system of the present invention includes a priority valve which is connected to the fluid source and has priority and secondary hydraulic circuitry extending therefrom. The priority valve is positioned under the influence of fluid pressure differentials applied against it. In response to operator desires to swing the backhoe apparatus from one position to another, the priority valve automatically directs a dedicated flow of actuating fluid through the priority circuit to the swing motors used to swing the backhoe apparatus into the desired swing position. The flow to the swing motors is independent of other backhoe functions concurrently operated therewith thereby allowing a substantially constant swing speed for the backhoe apparatus. When the backhoe apparatus is held in a static position, the priority valve automatically directs actuating fluid from the fluid source through the secondary circuit to other hydraulic motors in the hydraulic system.

6 Claims, 4 Drawing Sheets

HYDRAULIC SYSTEM FOR A BACKHOE APPARATUS

FIELD OF THE INVENTION

The present invention generally relates to a backhoe apparatus and, more particularly, to a hydraulic system which provides a priority flow of actuating fluid to hydraulic swing motors of the backhoe apparatus at a substantially constant regulated level selected by the operator regardless of other backhoe operations or their corresponding loads.

BACKGROUND OF THE INVENTION

A backhoe apparatus is typically mounted to a rear end of a tractor or other form of off-highway implement. Such a tractor is ordinarily equipped with a loader bucket or other tool at an opposite end of the tractor. Moreover, the tractor is steerable over the field.

A conventional backhoe apparatus includes a swing bracket or tower which attaches the backhoe apparatus to a frame of the tractor for lateral swinging movements in opposite directions and so as to allow the backhoe to assume a desired swing position relative to the frame of the tractor. The backhoe apparatus further includes a boom assembly pivotally connected at a lower end to the swing bracket and a dipper stick assembly attached toward an opposite end of the boom assembly. A bucket or other form of working tool is pivotally attached to a free end of the dipper stick assembly.

The loader bucket attached to a forward end of the tractor typically includes a pair of spaced loader arms extending from the tractor frame and having a loader bucket secured for tilting or rolling movement between the distal end of the loader arms. To further enhance the versatility of the apparatus, the bucket may be configured with a conventional two-piece clam shell design to effect a "grab" function.

A series of hydraulic motors are used to operate the loader bucket. A first pair of hydraulic motors are used to angularly position the loader arms and thereby control the elevation of the bucket relative to the tractor frame. A second pair of hydraulic motors are used to control the roll or pivotal movement of the loader bucket relative to the arms. Moreover, hydraulic motors are used for controlling articulated movements of the clam shell bucket to effect the "grab" function.

Another group or series of hydraulic motors are used to effect operation of the backhoe apparatus. The desired swing position of the backhoe apparatus is commonly controlled by a pair of hydraulic swing motors connected between the tractor frame and the swing bracket. The swing bracket and thereby the boom assembly is swung in an arcuate path about its pivotal connection to the tractor frame generally by extending one of the hydraulic motors and retracting the other hydraulic motor.

Positioning of the boom assembly relative to the swing bracket is effected by another pair of hydraulic motors. The relationship of the dipper stick assembly to the boom assembly is effected by operation of still another pair of hydraulic motors. Moreover, the position of the working tool or bucket on the backhoe apparatus is effected through actuation of still another hydraulic motor.

The ability to accurately control swinging movements of the backhoe apparatus is critical to the overall performance of the machine. When the backhoe is used in a digging operation, for example, the swing function is dramatic in that it controls the location whereat materials are discharged. Control over the swing function is also important to allow an operator to accurately return the backhoe apparatus to a precise digging position. One operation which is becoming increasingly popular with backhoes is that of using the boom assembly as a crane. As will be appreciated, accurate control of the swing function is of utmost importance where pipes or other heavy objects are to be fit into a narrow trench or the like. Particularly where the pieces being set constitute a heavy load, it is important to have complete control over the swing of the backhoe.

Heretofore known hydraulic systems used to control the swing function of a backhoe apparatus suffer serious drawbacks. Most of the known hydraulic systems provide adequate control of the swing function as long as no other hydraulic motors for the backhoe apparatus are actuated simultaneously therewith.

Effecting simultaneous backhoe functions, however, is common operator practice during operation of the backhoe apparatus. Conventional hydraulic systems will slow or even stop the swing of the backhoe apparatus when another backhoe function having a lower load requirement is performed simultaneously with the swing function. Correspondingly, the swing speed will increase when the alternative backhoe functions encounter a significant load or are stopped. The variation in swing speeds naturally occurs because the pressurized fluid in the hydraulic system takes the path of least resistance.

Operator control over swinging movements of the backhoe apparatus becomes very difficult because the swing speed can be influenced by other functions which are not related to the swing of the backhoe apparatus. Although known hydraulic systems limit maximum actuating fluid flow, they do not provide a priority flow path to the hydraulic swing motors and therefore the swing of the backhoe apparatus is subject to the flow requirements in other fluid circuits. The effects that these alternative functions have on the swing function can be compensated for by metering the various control valves used to control the various functions, but this operation requires a very skilled operator who is familiar with the machine. Alternatively, a pressure compensated flow control is used to maintain a substantially constant swing speed. As will be appreciated, the addition of a pressure-compensated flow control adds to both complexity and cost to the backhoe apparatus.

Thus, there is a need and a desire for a hydraulic system which provides a priority flow of actuating fluid to the hydraulic swing motors at a substantially constant level selected by the operator regardless of other backhoe functions simultaneously occurring therewith and their corresponding loads.

SUMMARY OF THE INVENTION

In view of the above, and in accordance with the present invention, there is provided a hydraulic system suited for use with a backhoe apparatus including a swing bracket. The hydraulic system is configured to direct a regulated priority flow of actuating fluid to hydraulic motors used to swingably move the swing bracket and the backhoe apparatus to a desired swing position and directs a residual flow of actuating fluid not required for swinging the backhoe to other hydraulic motors used for alternative backhoe functions. A salient feature of the hydraulic system of the present invention concerns a priority valve which is self-regulating and serves to direct a regulated priority flow of actuating fluid through a priority circuit to the hydraulic swing motors during swinging movements of the boom assembly.

The priority valve includes a valve spool whose axial position controls fluid communication between the actuating fluid source and the priority circuit, which directs a regulated actuating fluid flow to the hydraulic swing motors, and a secondary circuit. The position of the priority valve is influenced by pressure differentials applied against the valve spool. In response to the operator indicating a desire to swingably move the backhoe apparatus, a first fluid pressure signal is applied against the priority valve to direct a regulated flow of actuating fluid to the hydraulic swing motors. A second fluid pressure signal is applied against the valve spool to condition the priority valve to direct a residual flow of actuating fluid to other hydraulic motors in the hydraulic system when the fluid flow requirements of the hydraulic swing motors have been met or when the backhoe apparatus is in a static position.

The hydraulic motors used to swingably move the swing bracket and positively position the backhoe apparatus preferably includes a pair of hydraulic cylinders which, when actuated, operate in reverse order from each other. Each hydraulic cylinder is a double acting cylinder which is extensible and retractable in response to flow of actuating fluid to and from opposite ends of each cylinder.

The provision of a priority or dedicated circuit maintains a regulated flow of actuating fluid to the hydraulic swing motors at a level selected by the operator regardless of the flow demands of the other hydraulic functions of the machine. The regulated flow of actuating fluid to the hydraulic swing motors advantageously allows the operator to achieve a constant swing speed for the backhoe apparatus. Because a dedicated circuit is provided for swinging the backhoe, operation of other backhoe functions will not be proportionally increased or decreased during the swinging movements of the backhoe. Thus, the operator can simultaneously effect two or more backhoe functions with confidence regarding the swing speed and other movements of the backhoe thereby improving machine productivity and efficiency.

The constant flow of actuating fluid to the swing motors provided by the dedicated circuit substantially eliminates unwarranted changes in swing speed of the backhoe thus advantageously allowing operation of the backhoe near walls and for "craning" purposes where accuracy is of utmost importance. Moreover, because a constant swing speed is provided, the operator skill level-required for proper performance of the backhoe is reduced. Still another advantage of the present invention is that the actuating fluid not utilized by the swing motors is available for other hydraulic functions of the machine. Numerous other features and advantages of the present invention will become readily apparent from the following detailed description, the accompanying drawings, and the appended claims.

DETAILED DESCRIPTION OF THE PRESENT INVENTION

Figure 1:
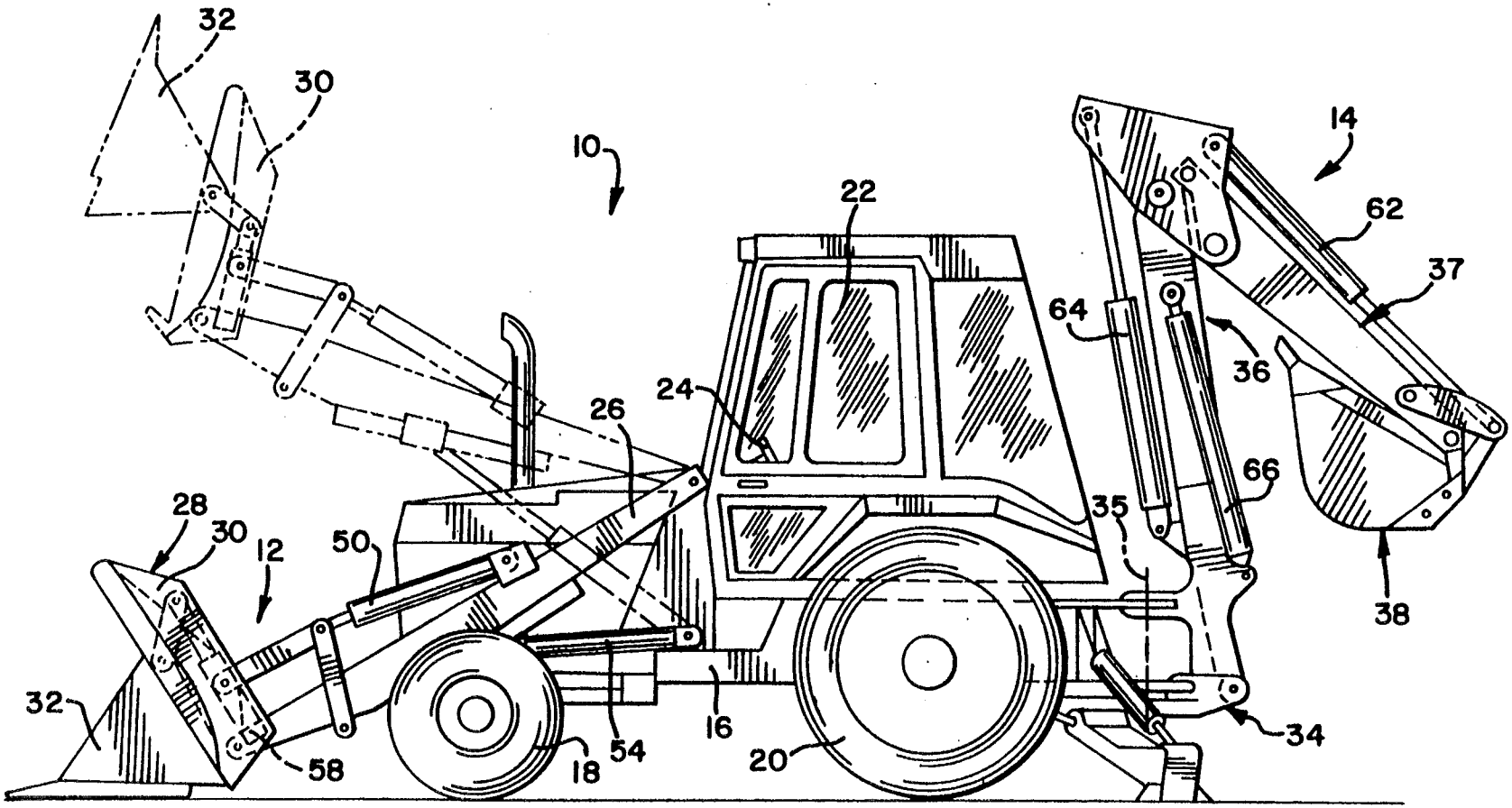
FIG. 1 is a side elevational view of a backhoe-carrying off-highway implement embodying principles of the present invention.

While the present invention is susceptible of embodiment in various forms, there is shown in the drawings a presently preferred embodiment hereinafter described, with the understanding that the present disclosure is to be considered as an exemplification of the invention and is not intended to limit the invention to the specific embodiment illustrated.

Referring now to the drawings, wherein like reference numerals indicate like parts throughout the several views, there is shown in FIG. 1 an off-highway implement or machine designated generally by reference numeral 10. Implement 10 serves as a carrying vehicle for a loader mechanism 12 attached thereto at a forward end thereof and a backhoe apparatus 14 attached thereto at a rearward end thereof. The implement 10 further includes a frame 16 mounted for movement over terrain by a pair of front steerable wheels 18 and a pair of rear drive wheels 20. A cab region 22 is defined between the wheels 18 and 20. Steering control as through a steering wheel 24 and other suitable controls (not shown) are provided in the cab region 22 for controlling operation of the loader mechanism 12 and backhoe apparatus 14.

The loader mechanism 12 is of a conventional design and includes a pair of fore-and-aft extending loader arms 26 located on opposite sides of the implement 10 and having their rear ends pivotally connected to the frame 16 for elevational movements about a generally horizontal axis. A working tool 28, such as a bucket, is pivotally connected between the forward ends of the arms 26 for pivotal or rolling movements.

In the illustrated embodiment, bucket 28 is capable of independent articulated movements such as shown in phantom lines in FIG. 1. Such a bucket typically includes a base member 30, connected to the loader arms 26 and a clam member 32 pivotally supported from the base member 30 and movable relative thereto between open and closed positions to effect a "grab" function for the loader apparatus.

The backhoe apparatus 14 includes a conventional swing bracket or tower 34 which attaches the backhoe apparatus 14 to the back of the frame 16 of implement 10 for swinging movement about a generally vertical axis 35. The backhoe apparatus 14 further includes an elongated boom assembly 36 pivotally connected toward a lower end to the swing bracket 34, a dipper stick assembly 37 connected to the upper end of the boom assembly 36, and a backhoe bucket or tool 38 arranged toward a free end of the dipper stick assembly 37.

Figure 2A:
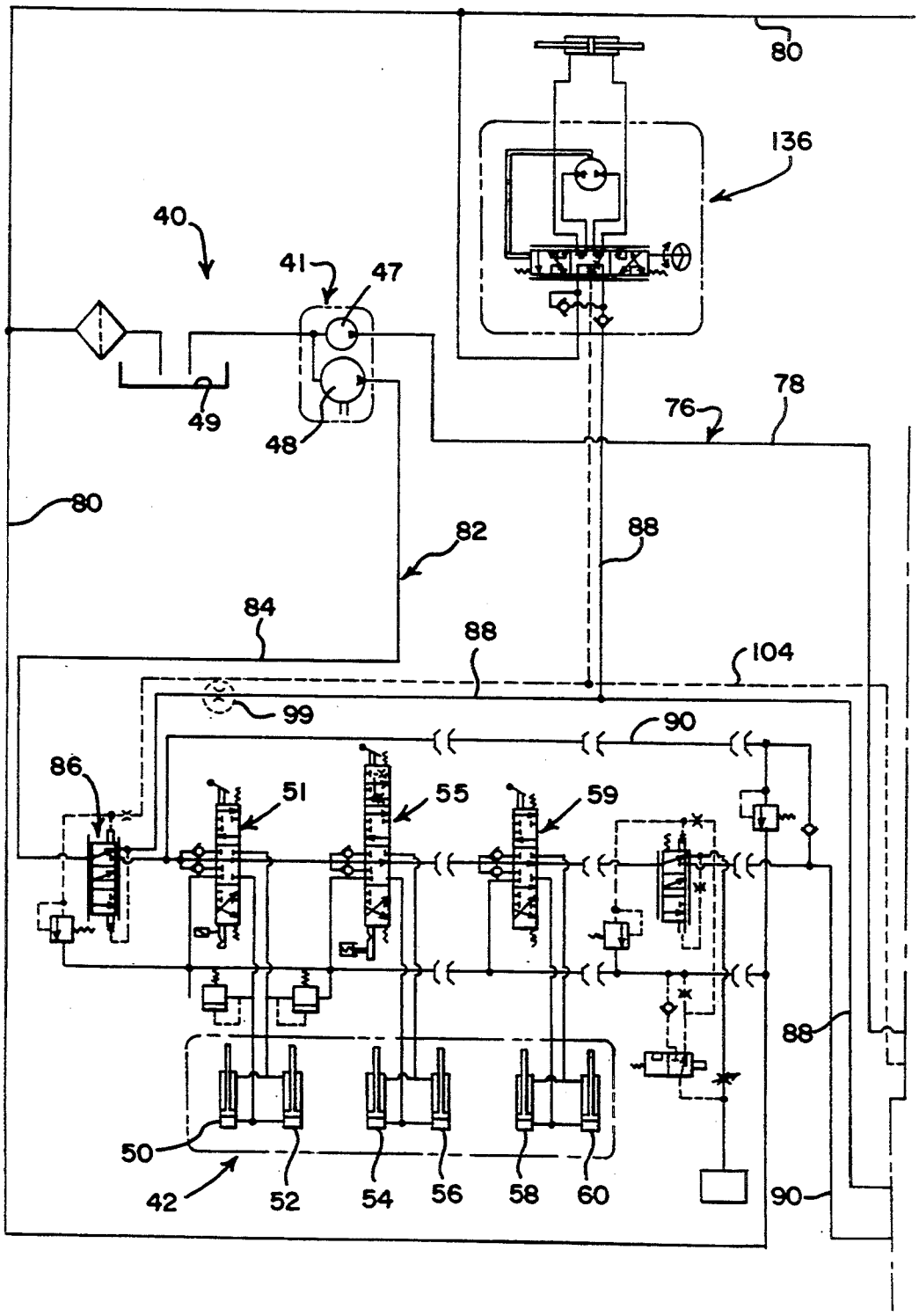
FIGS. 2A and 2B schematically represent a hydraulic system embodying principles of the present invention.
Figure 2B:
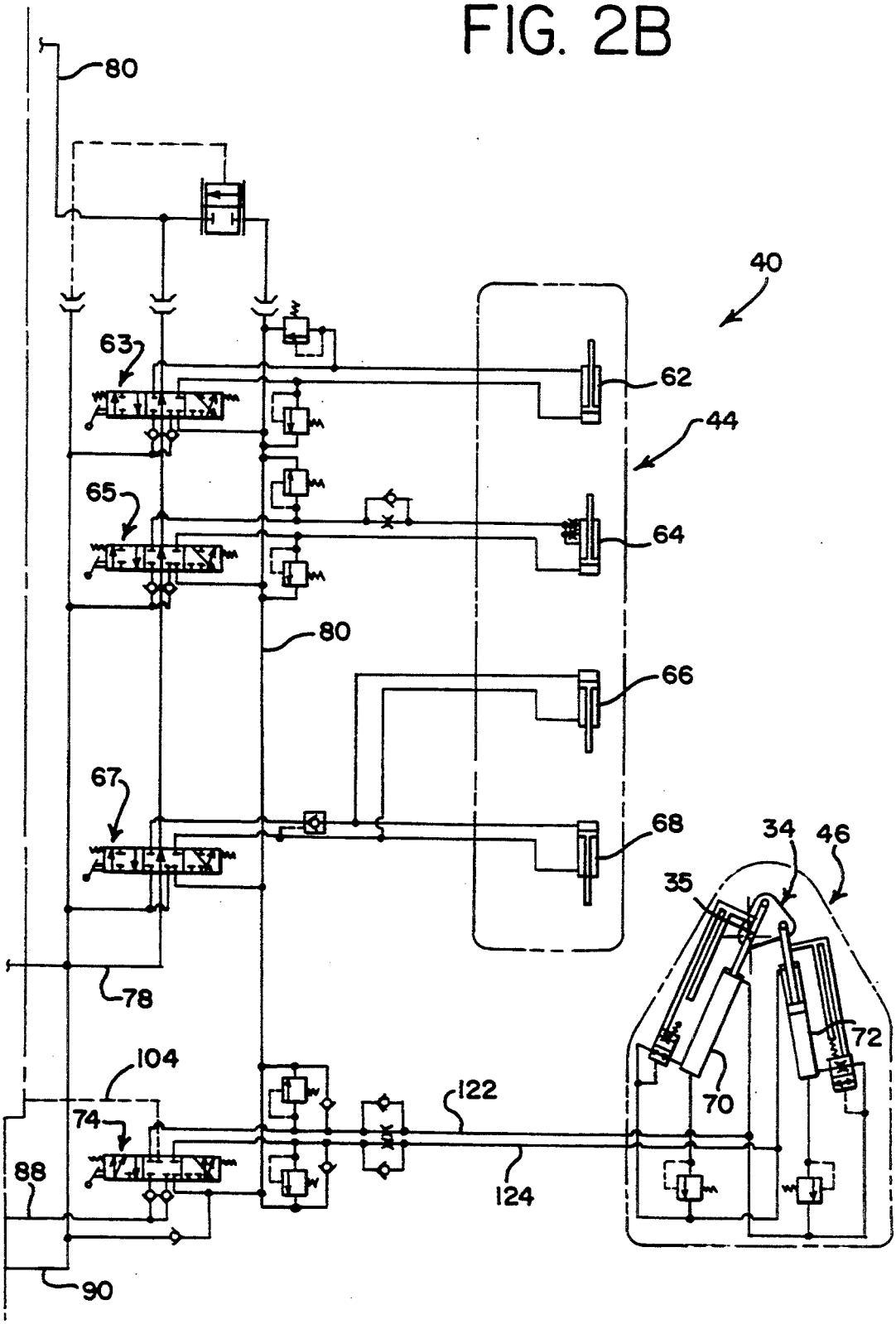

A hydraulic system, schematically illustrated in FIG. 2A and 2B and generally designated by reference numeral 40, regulates operation of the loader mechanism 12 and backhoe apparatus 14. The source of actuating fluid for the hydraulic system is derived from a hydraulic pump assembly 41 which is typically carried on the frame 16 on the machine 10 and is capable of providing a predetermined fluid flow output at a level adequate for the various series of hydraulic actuators disposed and arranged in combination with the machine 10. As shown in FIG. 2A, a first group of hydraulic actuators 42 is connected to the pump assembly 41 for operating the loader mechanism 12. As shown in FIG. 2B, second and third groups of hydraulic actuators 44 and 46, respectively, are likewise connected to the pump assembly 41 for positioning of the backhoe bucket 38 relative to the implement frame 16 and for holding the swing bracket 34 and thereby the backhoe apparatus 14 in a desired swing position, respectively.

As shown in FIG. 2A, pump assembly 41 preferably includes first and second pumps, 47 and 48, respectively, conventionally driven from a suitable source of power on the implement and which have intakes which receive fluid from a common reservoir 49. Each pump 47, 48 is of a conventional design and is capable of exhausting actuating fluid from an outlet thereof at a pressure suitable to effect operation of the hydraulic groups of actuators 42, 44, and 46 connected thereto.

In the illustrated embodiment, the first group of hydraulic actuators 42 includes a pair of hydraulic tilt cylinders 50 and 52 for effecting pivotal or rolling movements of the bucket 30 relative to the loader arms 26. The first group of hydraulic actuators 42 further includes a pair of hydraulic lift cylinders 54 and 56 interconnected between the implement frame 16 and the loader arms 26 to elevationally position the bucket 28 relative to the frame 16. Moreover, the first group of hydraulic actuators 42 includes a pair of hydraulic cylinders 58 and 60 for effecting articulated movements of movable clam member 32 relative to base member 30 between open and closed positions to effect a "grab" function. Each hydraulic cylinder in the first group of hydraulic actuators 42 is preferably in the form of a double acting hydraulic cylinder which is provided with conventional plumbing connections to-provide hydraulic fluid under pressure thus effecting extension/retraction of the respective cylinder.

A series of conventional and multi-positional control valves preferably operated from the cab region 22 are hydraulically interposed between the pump assembly 41 and the first group of hydraulic actuators 42 for effecting operation of the loader mechanism 12. As shown, an operator controlled open center valve 51 controls operation of the tilt cylinders 50, 52 and, thus, controls rolling or pivotal movements of the bucket 28 relative to the loader arms 26. An operator controlled open center valve 55 controls operation of the lift cylinders 54, 56 and, thus, regulates elevation of the bucket 28. An operator controlled open center valve 59 controls operation of the grab cylinders 58, 60 and, thus controls the "grab" function of the bucket 28.

The second group of hydraulic actuators 44 includes a hydraulic bucket cylinder or curl actuator 62 connected between the dipper stick assembly 37 and bucket 38. The dipper stick assembly 37 is moved under the influence of a hydraulic dipper stick cylinder 64 connected between the dipper stick assembly 37 and the boom assembly 36. A pair of transversely spaced boom cylinders 66 and 68 are provided to move the boom assembly 36 relative to the swing bracket 34. Each hydraulic cylinder in the second group of hydraulic actuators 44 is preferably in the form of a double acting hydraulic cylinder which is provided with conventional plumbing connections to provide hydraulic fluid under pressure thus effecting various functions as controlled by the cylinder.

A series of conventional multi-positional control valves preferably operated from the implement cab region 22 are hydraulically interposed in series between the pump assembly 41 and the second group of actuators 44 for effecting operation of the backhoe apparatus 16. As shown, an operator controlled open center valve 63 controls actuating fluid flow to and from the hydraulic bucket cylinder 62 to control the position of bucket 38 relative to the dipper stick assembly 37. An operator controlled open center valve 65 controls actuating fluid flow to and from the dipper stick cylinder 64 to thereby control operation of the dipper stick assembly 37. Moreover, an operator controlled open center valve 67 controls actuating fluid flow to from the boom cylinders 66 and 68 to control the angular disposition of the boom assembly 36 relative to tower 39.

The third group of hydraulic actuators 46 includes a pair of swing cylinders 70 and 72 which are adapted to operate in reverse order relative to each other. The cylinders 70 and 72 are connected between the frame 16 of the implement and the swing bracket 34. Each of the cylinders 70, 72 is preferably in the form of a double acting hydraulic cylinder which is provided with conventional plumbing connections to provide hydraulic fluid under pressure thus effecting operation of the cylinders in reverse order relative to each other.

Figure 5:
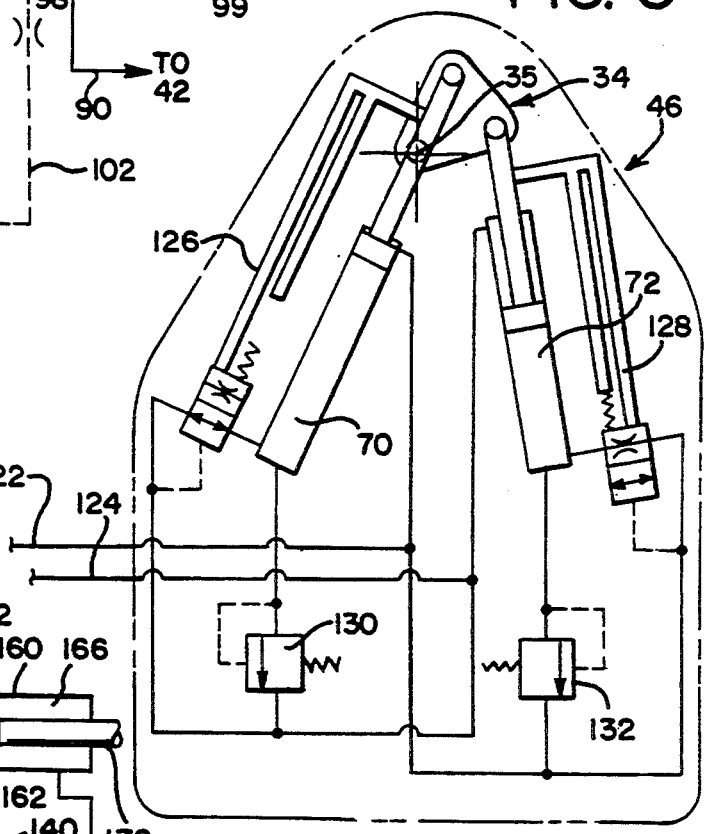
FIG. 5 is a schematic representation of the swing motors for effecting positive positioning and swinging movements of the backhoe apparatus.

As will be appreciated, and as shown in FIGS. 2B and 5, extension of cylinder 70 along with simultaneous contraction of cylinder 72 causes the swing bracket 34 to swing or pivot clockwise about the vertical axis 35 thus positioning the backhoe apparatus 16 in a desired swing position. Conversely, extension of swing cylinder 72, accompanied by contraction of swing cylinder 70, causes counterclockwise swinging or pivotal movement of the swing bracket 34 about the vertical axis 35 thus positioning the backhoe apparatus 16 in a desired swing position.

As will be described in further detail below; the flow of actuating fluid to and from the hydraulic swing cylinders 70, 72 is effected through positional movement of a multi-positional closed center control valve 74. The backhoe apparatus 14 may be swung to the left, or to the right, or positively held in a desired swing position depending upon the position of control valve 74.

In the illustrated embodiment, first hydraulic circuitry 76 extends between the pump assembly 41 and the second group of hydraulic actuators 44. As shown, circuitry 76 includes a supply line 78 extending from the outlet of pump 47 of pump assembly 41 to an inlet port of each control valve 63, 65, and 67. Circuitry 76 also includes a return line 80 leading from an exhaust port of each of the control valves 63, 65, and 67 associated with the second group of hydraulic actuators 44.

A salient feature of the present invention concerns second hydraulic circuitry 82 arranged independent of the first hydraulic circuitry 76 for directing a priority or dedicated flow of actuating fluid from the pump assembly 41 to effect actuation and operation of the hydraulic swing cylinders 70 and 72. As shown, the second hydraulic circuitry 82 includes a supply line 84 extending from an outlet of pump 48 of pump assembly 41 to a priority valve 86. A priority circuit 88 and a secondary circuit 90 extend from the priority valve 86.

When the operator desires to change the swing position of the backhoe apparatus 14 relative to the frame 16 of the implement, the priority valve 86 is designed to direct a priority or dedicated flow of actuating fluid from pump assembly 41 to the hydraulic swing actuators 70, 72 through the priority circuit 88. When the hydraulic actuators 70, 72 are utilized to positively position the backhoe apparatus 14 in a desired swing position, the priority valve 86 regulates itself and directs a residual flow of actuating fluid to the secondary circuit 90 and, ultimately, to other hydraulic actuators on the implement used for functions other than swinging movements of the backhoe apparatus 16.

Figure 3:
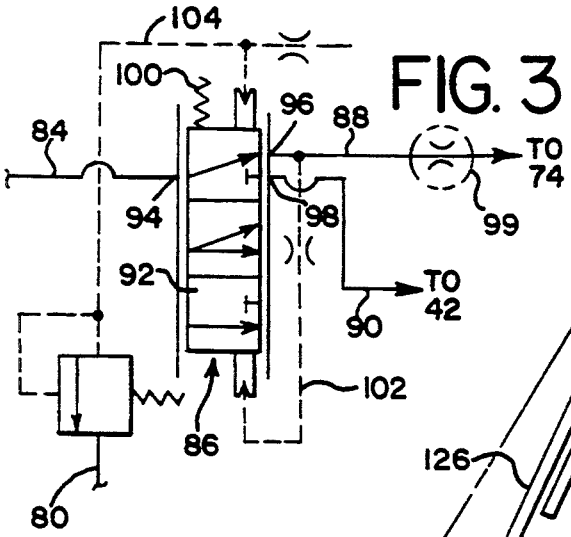
FIG. 3 is an enlarged schematic illustration of a priority valve forming part of the hydraulic system of the present invention.

As shown in FIG. 3, the priority valve 86 includes an axially shiftable valve spool 92 whose linear or axial position controls fluid communication between an inlet port 94 and two outlet ports 96 and 98. As shown, inlet port 94 is connected to the supply line 84 leading from pump assembly 41. Outlet port 96 is connected to the priority circuity 88 leading to the actuators 70, 72 while outlet port 98 is connected to the secondary circuity 90 leading to other hydraulic actuators on implement 10.

Structure is arranged in the priority circuit 88 downstream of the priority valve 86 for positioning the priority valve 86 such that a prioritized fluid flow from the pump assembly 41 is directed to the operator controlled swing valve 74 and, ultimately, to the swing cylinder 70, 72 through the priority circuit 88. Such structure also serves to position the priority valve 86 to direct a residual fluid flow from the pump assembly 42 to the second circuit 90 and the hydraulic actuators associated therewith after a prioritized fluid flow has been established in the priority circuit leading to the swing valve 74. Notably, such structure serves to limit the fluid flow to a level less than the predetermined output flow capacity of the pump assembly 41 whereby regulating the maximum speed of swinging movements of the swing bracket 34 and thereby the backhoe apparatus 14 relative to the frame 16 of the machine 10.

In the illustrated form of the invention, such structure includes a sized orifice 99 hydraulically interposed between the outlet port of 96 of priority valve 86 and the closed center control valve 74. The sized orifice 99 serves a dual purpose or function. First, the orifice or restriction 99 in the priority circuit 88 established a pressure drop thereacross and such that the fluid pressure between the outlet port 96 and the restriction 99 is typically higher that the fluid pressure between the restriction 99 and the closed center swing valve 74. In the illustrated embodiment, the restriction 99 is sized to effect a pressure drop in the range of about 75 psi to about 200 psi on opposite sides thereof. In a most preferred form of the invention, about 100 psi pressure drop is effected across the restriction. Also, the restriction 99 limits or controls the maximum fluid flow to the swing motors 70 and 72 thereby regulating the maximum swing speed of the swing bracket 34 and thereby the backhoe apparatus 14. As shown, a spring 100 biases the valve spool 92 in a first direction. Spring 100 is configured to bias the spool vale 92 with a force equal to the pressure drop across the restriction 99. Operation of the priority valve 86 is accomplished by fluid pressure differentials applied against the valve spool 92. As shown in FIG. 3, a first load pressure signal line 102 branches off the priority circuit 88 upstream of the orifice or restriction 99. Fluid pressure in the signal line 102 applies a first fluid pressure signal against the valve spool 92 in a direction opposite to the force of spring 100. A second load pressure signal line 104 directs a second fluid pressure signal against the valve spool 92 and acts in concert with the force of spring 100.

Figure 4:
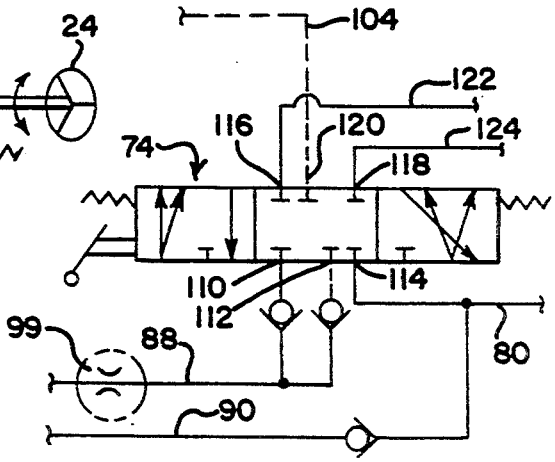
FIG. 4 is an enlarged schematic illustration of a swing control valve forming pan of the hydraulic system of the present invention.

As schematically illustrated in FIG. 4, the closed center control valve 74 for regulating operation of hydraulic swing actuators 70 and 72 is connected to the priority circuit 88 downstream of restriction 99. As shown in FIG. 4, control valve 74 includes inlet ports 110 and 112, an outlet port 114, a pair of motor ports 116 and 118, and a load pressure signal port 120. Notably, the second load pressure signal line 104 leads from the load signal port 120. The control valve 74 is movable between a neutral or blocked center position, as shown in FIG. 4, rightwardly to a first operating position and leftwardly to a second operating position.

In a neutral or blocked center position, the inlet ports 110 and 112, the outlet port 114, and the motor ports 116, 118 are all isolated from one another. At the first operating position, the inlet port 110 is in communication with the motor port 116 and the load signal port 120 while the motor port 118 is in communication with the outlet port 114. At the second operating position, the inlet port 112 is in communication with motor port 118 and the signal pressure port 120 while motor port 116 is in communication with the outlet port 114.

As shown in FIGS. 4 and 5, a first fluid pressure conduit 122 connects motor port 116 of valve 74 with a rod end of hydraulic cylinder 70 and with a head end of hydraulic cylinder 72. Similarly, a second fluid pressure conduit 124 connects motor port 118 of valve 74 with a head end of hydraulic cylinder 70 and with a rod end of hydraulic cylinder 72. In the illustrated embodiment, a pair of conventional decelerators 126, 128 are associated with the hydraulic cylinders 70 and 72, respectively. Moreover, a pair of line relief valves 130 and 132 are connected to the respective fluid pressure conduits 122 and 124.

Figure 6:
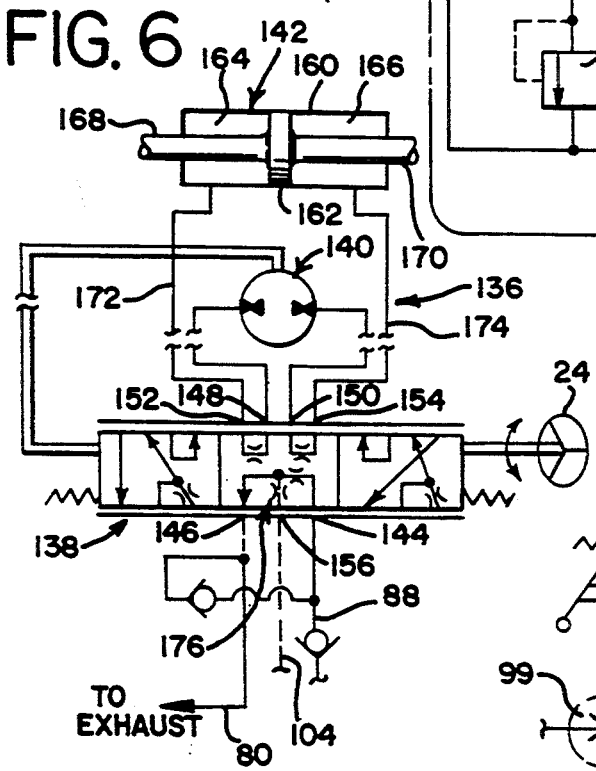
FIG. 6 is schematic illustration of a steering control valve forming part of the hydraulic system of the present invention.

In the illustrated embodiment, a hydraulic steering assembly 136 is likewise connected to the priority circuit 88. As shown in FIG. 6, the hydraulic steering assembly 136 includes a multipositional steering valve 138 whose position is influenced by the rotational position of the implement steering wheel 24 and which is hydraulically connected in a conventional manner to a pump 140 and to a hydraulic actuator 142.

As shown in FIG. 6, valve 138 includes an inlet port 144, an outlet port 146, a pair of pump ports 148, 150, a pair of motor ports 152, 154, and a load pressure signal port 156. The priority circuit 88 is connected to the inlet port 144. Outlet port 146 is connected to exhaust over lane 80, and the load pressure signal port 156 is connected to the load pressure signal line 104 leading to the priority valve 86.

Hydraulic actuator 142 includes a cylinder 160 supported on the implement frame 16 and a piston 162 slidably received in the cylinder 160. Cylinder 160 and piston 162 combine to define fluid receiving chambers 164 and 166 on opposite sides of piston 162. Moreover, piston 162 has axially aligned extensions 168, 170 extending away therefrom to an exterior of the cylinder 160. As will be appreciated, the extensions 168, 170 are sealed in a conventional manner relative to the cylinder 160. The free ends of the piston extensions 168, 170 are connected to steering links (not shown) forming part of a steering mechanism for implement 10. A first fluid conduit 172 extends from motor port 152 of valve 138 and opens to fluid receiving chamber 164 of cylinder 142. A second fluid conduit 174 extends from motor port 154 of valve 13&' and opens to fluid receiving chamber 166 on cylinder 142.

When the implement is not being steered, and the steering wheels are positioned for straight movement, the steering valve 138 assumes a blocked center position whereat the inlet port 144 of steering assembly 138 is isolated from the pump ports 148, 150 and the motor ports 152, 154, but is in communication with outlet port 146 and the load pressure signal port 156. Notably, the inlet port 144 communicates with the load pressure signal port 156 preferably across a dual orifice arrangement 176 which maintains a minimum fluid pressure in the load pressure signal line 104.

When the steering wheel 24 is rotated clockwise as seen in FIG. 6, to steer the implement to the right, valve 138 is shifted to the right such that inlet port 144 communicates with pump port 148 to rotate pump 140 in a clockwise direction. When pump 140 rotates in a clockwise direction, pump port 150 communicates with motor port 154, and fluid is delivered to the fluid receiving chamber 166 to move piston 162 to the left thus causing the implement to be steered to the right. With valve 138 in this position, fluid chamber 164 is open to exhaust across ports 152 and 146.

Conversely, when the vehicle is to be steered to the left, steering wheel 24 is rotated in a counterclockwise direction. Rotation of the steering wheel 24 in a counterclockwise direction causes the valve 138 to shift to the left thus allowing input port 144 to communicate with pump port 150 and thereby driving the pump 140 in a counterclockwise direction. When pump 140 is driven in a counterclockwise direction, actuating fluid from the priority circuit 88 is delivered across pump port 148 to motor port 152 and delivered to the fluid receiving chamber 164, thus causing the piston 162 to move to the right. With valve 138 in this position, fluid chamber 166 is open to exhaust across ports 154 and 146.

Notably, when a steering movement is imparted to the valve 138, the inlet port 144 communicates with the load pressure signal port 156 across orificed structure 176. Thus, a load pressure signal is provided to the priority valve 86 over the load pressure signal line 104.

At the onset of implement operation, pump assembly 41 simultaneously provides actuating fluid to both the first and second hydraulic circuitries 76 and 82. In the illustrated embodiment, the actuating fluid in the first fluid pressure circuit 76 is delivered to the group of hydraulic actuators 44. Actuating fluid in the second hydraulic circuitry 82 is delivered to the priority valve 86.

At the onset of implement operation, the priority valve 86 initially assumes a position as shown in FIG. 3 under the influence of spring 100. At the onset of machine operation, there will be little or no fluid flow in the signal line 102 acting against spring 100 and, thus, spring 100 will resiliently urge the spool valve 92 into the position shown and fluid flow will pass through the restriction 99 to the swing valve 74. Having once established fluid flow to the priority valve 86, the spool valve 92 shift from the solid line position shown in FIG. 3. Because swing valve 74 is configured as a closed center valve, there will be little or no pressure in signal line 104. Accordingly, the fluid flow in signal line 102 will cause the spool valve 92 to shift against the action of spring 100 to establish a fluid flow in the secondary circuit 90 to the groups of hydraulic actuators 42 and 44.

When the backhoe apparatus 14 is to be swung into a desired swing position, however, a priority or dedicated flow of actuating fluid is directed from the pump assembly 41 to the motors 70 and 72 independently of the flow of actuating fluid to the other hydraulic actuators used on the implement. When the backhoe apparatus 14 is to be moved, the swing control valve 74 is shifted under the influence of an operator into a first or second position.

When swing control valve 74 is shifted into a first position, inlet port 110 is connected to the motor port 116 while motor port 118 is connected to exhaust port 114 thus allowing the hydraulic cylinders 70 and 72 to operate in a reverse order relative to each other. When valve 74 is so positioned, however, inlet port 110 is likewise connected to the load signal port 120. Accordingly, a fluid pressure signal is delivered through the load pressure signal line 104 and is directed to the priority valve 86. The fluid pressure signal in the load pressure signal line 104, in combination with the action of spring 100 causes the spool valve 92 to return to the position shown in FIG. 3.

As will be appreciated, the priority valve 86 acts as a load sensing valve which regulates itself during operation of the backhoe. That is, spool valve 92 will remain in the position shown in FIG. 3 as long as a load pressure signal indicative of swinging movement of the backhoe apparatus 14 is delivered through the load pressure line 104. That is, when the swing valve is shifted away from its closed center position, fluid flow is established in the signal line 104 which combines with the spring 100 to maintain the spool valve 92 in the position shown in FIG. 3. With the priority valve 86 in the shifted position illustrated in FIG. 3, a dedicated flow of actuating fluid is delivered to the fluid pressure actuators 70, 72 across the priority circuit 88. Notably, the restriction or orifice 99 acts to limit the maximum fluid flow to the swing valve at something less than the full output capacity of the pump assembly 41. As will be appreciated, regulating the fluid flow to the swing valve 74 will control the maximum swing speed for the swing bracket 34 and thereby the backhoe apparatus 14 relative to the frame 16. A salient feature of the present invention being that a continuous swing speed for the swing bracket 34 and thereby the backhoe apparatus is accomplished notwithstanding simultaneous flow to other hydraulic motors in the hydraulic system. After a maximum flow of actuating fluid to the actuators 70, 72 has been accomplished through the priority circuit 88 by the structure including restriction 99, the output capacity of the pump assembly 41 is such that the priority valve 86 can assume a position whereat actuating fluid flow is directed to the priority circuit 88 to maintain a constant flow of fluid to the actuators 70, 72 while a residual flow of actuating fluid is directed into the secondary circuit 90.

After the backhoe apparatus 14 is moved into the desired swing position, the swing control valve 74 is returned by the operator to a neutral position. As mentioned, when swing control valve 74 is in a neutral or blocked center position, the load pressure signal line 104 is blocked from receiving fluid across the valve structure 74 and the fluid pressure drops therein. Thus, the priority valve 86 is automatically shifted under the influence of the fluid pressure directed thereagainst through signal line 102 in the manner discussed above.

With the present invention, and in response to the operator desiring to move the backhoe apparatus 14 from one swing position to another swing position, a priority flow of actuating fluid is directed between the pump assembly 41 and across the priority valve 86 through the priority circuit 88 to the swing cylinders 70 and 72 to ensure that the flow of actuating fluid thereto will be constant at a level selected by the operator regardless of other functions of the implement. Providing a regulated priority flow of actuating fluid to the cylinders 70 and 72 allows the swing speed of the backhoe apparatus to be maintained substantially constant at speeds selected by the operator.

Advantageously, the priority flow to the swing cylinders 70, 72 allows the other backhoe functions to not proportionately increase or decrease in speed. Thus, an operator having fewer skills can efficiently and effectively operate the backhoe apparatus 16. Another feature of the present invention is that a residual flow of actuating fluid is provided to other hydraulic actuators on the implement after a maximum flow of actuating fluid is directed to the swing motors 70, 72 or to the hydraulic steering assembly 136. The elimination of varying speeds throughout the range of movement of the backhoe apparatus 16 increases the versatility of the backhoe apparatus 16 by allowing it to be used for craning and accurate location of the tool by the operator.

As will be understood, the implement 10 is not subject to steering during operation of the backhoe apparatus 14. Conversely, the backhoe apparatus 14 is not operated during implement steering. A priority flow of actuating fluid is likewise directed to a steering assembly 136 by the priority valve 86 in response to turning movements of the steering wheel 24. When the implement is not being steered, the priority valve 86 provides a residual flow of actuating fluid to hydraulic actuators other than that used for steered.

From the foregoing, it will be observed that numerous modifications and variations can be effected without departing from the true spirit and scope of the novel concept of the present invention. It will be appreciated that the present disclosure is intended as an exemplification of the invention, and is not intended to limit the invention to the specific embodiment illustrated. The disclosure is intended to cover by the appended claims all such modifications as fall within the scope of the claims.

What is claimed is:

1. A hydraulic system for a backhoe apparatus mounted on a machine, said backhoe apparatus including a swing bracket for connecting a boom assembly to the machine for swinging sideways movements, said hydraulic system comprising:

a source of actuating fluid carried on the frame of the machine and capable of providing a predetermined output flow of fluid;

a first series of hydraulic motors for moving the boom assembly relative to the swing bracket;

a first series of open center operator controlled valves for controlling the flow of actuating fluid between said actuating fluid source and the first series of hydraulic motors thereby positioning the boom assembly relative to the swing bracket;

a second series of hydraulic motors for swinging the swing bracket relative to the frame of the machine;

a closed center operator controlled swing valve for controlling the flow of actuating fluid between said actuating fluid source and said second series of hydraulic motors, said swing valve operating to positively hold the backhoe apparatus in a desired position as long as said swing valve is maintained in a closed center position and for causing the second series of hydraulic actuators to swingably move the swing bracket and the boom assembly connected thereto in swinging sideways movements when said swing valve is removed from its closed center position;

first hydraulic circuitry extending from the actuating fluid source for directing actuating fluid to and from said first series of hydraulic motors used to position the boom assembly relative to the swing bracket; and second hydraulic circuitry arranged independent of said first hydraulic circuitry and including a priority circuit for directing a priority flow of actuating fluid between the actuating fluid source and the second series of hydraulic motors, and a secondary circuit for directing a residual flow of actuating fluid to said first series of hydraulic motors; and a priority valve operably disposed between said actuating fluid source and said priority and secondary circuits, said priority valve having an inlet port connected to said actuating fluid source, a first outlet port that opens to said priority circuit, and a second outlet port that opens to the secondary circuit; and structure arranged in said priority circuit downstream of said priority valve for positioning said priority valve such that a prioritized flow of fluid from said actuating fluid source is directed to the second series of hydraulic motors through the priority circuit and for positioning the priority valve to direct a residual flow of fluid from said actuating fluid source to the first series of hydraulic motors after the prioritized flow has been established to the second series of hydraulic motors, and wherein said structure limits the fluid flow that is delivered to the second series of hydraulic motors to a level less than the predetermined output flow of the actuating fluid source whereby regulating the speed of the swinging movements of the swing bracket and thereby the backhoe apparatus.

2. The hydraulic system according to claim 1 wherein said priority valve includes a spring biased valve spool whose linear position controls fluid communication between the input and output ports of said priority valve, the position of said valve spool being influenced by fluid pressure differentials applied thereto.

3. The hydraulic system according to claim 1 wherein said first series of hydraulic motors comprises a plurality of hydraulic cylinders, each cylinder being extensible and retractable in response to flow of actuating fluid to and from opposite ends of the cylinder.

4. The hydraulic system according to claim 1 wherein said second series of hydraulic motors comprises first and second hydraulic cylinders, each hydraulic cylinder being extensible and retractable in response to flow of actuating fluid to and from opposite ends of each cylinder.

5. A hydraulic system for a backhoe apparatus mounted on a machine by a swing bracket to swing about a generally vertical axis to opposite sides of the machine, said hydraulic system comprising:

two independent hydraulic circuits, wherein a first hydraulic circuit is used to direct a priority flow of actuating fluid to a first series of hydraulic motors used to position and swing the backhoe apparatus and a second hydraulic circuit used to direct a residual flow of actuating fluid to a second series of hydraulic motors, and wherein said first hydraulic circuit includes operator controlled valves for selectively controlling fluid flow to the first series of hydraulic motors thereby controlling the swing speed of the backhoe apparatus, and wherein said second hydraulic circuit includes operator controlled valves for selectively controlling fluid flow to the second series of hydraulic motors;

a source of actuating fluid carried on the frame of the machine and capable of providing a predetermined output flow of fluid;

a priority valve having an input port connected to the actuating fluid source and first and second outlet ports, said first outlet port of said priority valve opening to the first hydraulic circuit, said second outlet port of said priority valve opening to the second hydraulic circuit, and wherein said priority valve includes a spring biased axially shiftable valve spool which opens and closes fluid communication between the input and output ports of said priority valve as a function of the axial position thereof; and structure arranged downstream of said priority valve for positioning said valve spool such that a prioritized flow of fluid from the actuating source is directed through the first series of hydraulic motors through said first hydraulic circuit and for positioning said valve spool to direct a residual flow of fluid from said actuating fluid source to the second series of hydraulic motors after the prioritized flow has been established to the first series of hydraulic motors, and wherein said structure controls the fluid flow that is delivered to the first series of hydraulic motors to be less than the predetermined output flow of the actuating fluid source whereby a selectively continuous swing speed is accomplished for the swing bracket and thereby the backhoe apparatus notwithstanding simultaneous fluid flow to other hydraulic motors in the hydraulic system.

6. A hydraulic system for an off-highway machine having a mobile frame, a pair of laterally spaced loader arms pivotally connected at and extending forwardly frozen one end of the frame, a bucket connected between the arms at an opposite end thereof for tilting movements, a backhoe apparatus attached to an opposite end of the frame by a swing bracket for movement in opposite directions, said hydraulic system comprising:

a source of actuating fluid carried on the frame of the machine and capable of providing a predetermined fluid flow output;

a first group of hydraulic motors for operating the bucket;

a second group of hydraulic motors connected between the swing bracket and the frame of the machine for causing the backhoe apparatus to swing in opposite directions;

a priority valve having an input port connected to said source of actuating fluid and two output ports, said priority valve including an axially shiftable valve spool for automatically opening and closing fluid communication between the input port and the output ports in response to swinging movements of the backhoe apparatus; and first and second separate fluid circuits for directing pressurized fluid between the output ports of the control valve and the first and second groups of hydraulic motors, said first circuit leads from the first output port on the valve and includes a first series of open center operator controlled valves for controlling fluid flow between said actuating fluid source and said first series of hydraulic motors thereby selectively controlling operation of the bucket, and wherein said second circuit leads from the second outlet port on the valve and includes a closed center operator controlled swing valve for controlling the fluid flow between the actuating fluid source and the second series of hydraulic motors thereby selectively controlling swinging movements and speed of the backhoe apparatus in opposite directions; and structure arranged downstream of said priority valve for positioning said valve spool such that a prioritized fluid flow from the actuating fluid source is directed to said swing valve through said second circuit and for positioning said priority valve to direct a residual fluid flow to the second series of operator controlled valves after the prioritized fluid flow is established in said second circuit, and wherein said structure controls the fluid flow delivered to the swing valve at a rate less than the predetermined output flow of the actuating fluid source whereby a selectively continuous swing speed is accomplished for the swing bracket and thereby the backhoe apparatus notwithstanding simultaneous fluid flow to the first series of hydraulic motors.

* * * * *